US010018064B2

(12) United States Patent
Wilber et al.

(10) Patent No.: US 10,018,064 B2
(45) Date of Patent: Jul. 10, 2018

(54) FLOATING PANEL FOR A GAS POWERED TURBINE

(71) Applicant: United Technologies Corporation, Hartford, CT (US)

(72) Inventors: John E. Wilber, East Hampton, CT (US); Craig Hart, Hartford, CT (US)

(73) Assignee: United Technologies Corporation, Farmington, CT (US)

( * ) Notice: Subject to any disclaimer, the term of this patent is extended or adjusted under 35 U.S.C. 154(b) by 466 days.

(21) Appl. No.: 14/635,394

(22) Filed: Mar. 2, 2015

(65) Prior Publication Data

US 2016/0258307 A1 Sep. 8, 2016

(51) Int. Cl.
*F01D 25/30* (2006.01)
*F01D 11/00* (2006.01)
(Continued)

(52) U.S. Cl.
CPC ..... *F01D 11/005* (2013.01); *F01D 5/14* (2013.01); *F01D 5/146* (2013.01); *F01D 9/041* (2013.01); *F01D 9/042* (2013.01); *F01D 25/246* (2013.01); *F01D 25/30* (2013.01); *F05D 2220/32* (2013.01); *F05D 2230/642* (2013.01); *F05D 2240/11* (2013.01); *F05D 2240/12* (2013.01); *F05D 2240/55* (2013.01); *F05D 2240/80* (2013.01)

(58) Field of Classification Search
CPC ..... F01D 25/30; F01D 25/246; F01D 11/005; F01D 9/042; F01D 5/146
See application file for complete search history.

(56) References Cited

U.S. PATENT DOCUMENTS 4,302,941 A 12/1981 DuBell
4,653,279 A 3/1987 Reynolds
(Continued)

FOREIGN PATENT DOCUMENTS

GB 2262573 6/1993
GB 2280484 2/1995
(Continued)

OTHER PUBLICATIONS

European Search Report for Application No. 16158099.8 dated Jun. 27, 2016.

*Primary Examiner* — Logan Kraft
*Assistant Examiner* — Sabbir Hasan
(74) *Attorney, Agent, or Firm* — Carlson, Gaskey & Olds, P.C.

(57) ABSTRACT

A foil assembly for a gas powered turbine includes a plurality of floating wall sectors arranged circumferentially about an axis defined by a flowpath. Each of the floating wall sectors includes a first flowpath strut component, a second flowpath strut component, a floating wall panel connected to the first flowpath strut component by a first clamp seal at a first axial joint and connected to the second flowpath strut component by a second clamp seal at a second axial joint, and a plurality of leading edge structures fore of the plurality of floating wall sectors. Each of the leading edge structures is configured to define a foil profile in conjunction with a first flowpath strut component of a first floating wall sector and an adjacent flowpath strut component of a second floating wall sector.

16 Claims, 7 Drawing Sheets

(51) Int. Cl.

| | |
|---|---|
| ***F01D 5/14*** | (2006.01) |
| ***F01D 9/04*** | (2006.01) |
| ***F01D 25/24*** | (2006.01) |

(56) References Cited

U.S. PATENT DOCUMENTS

| | | | | |
|---|---|---|---|---|
| 4,921,401 | A | 5/1990 | Hall et al. | |
| 5,323,601 | A | 6/1994 | Jarrell et al. | |
| 5,451,116 | A * | 9/1995 | Czachor | F01D 9/065 403/28 |
| 5,705,231 | A * | 1/1998 | Nissley | C23C 4/02 427/419.3 |
| 8,596,963 | B1 | 12/2013 | Liang | |
| 8,646,744 | B2 * | 2/2014 | Duchatelle et al. | F01D 9/04 248/637 |
| 2011/0073745 | A1 | 3/2011 | Duchatelle et al. | |
| 2012/0204727 | A1 | 8/2012 | Norlund | |

FOREIGN PATENT DOCUMENTS

| | | |
|---|---|---|
| JP | 3689113 | 8/2005 |
| JP | 2005300141 | 10/2005 |
| WO | 2013095211 | 6/2013 |
| WO | 2014076407 | 5/2014 |
| WO | 2015116495 | 8/2015 |

* cited by examiner

FLOATING PANEL FOR A GAS POWERED TURBINE

STATEMENT REGARDING FEDERALLY SPONSORED RESEARCH OR DEVELOPMENT

This invention was made with government support under Contract No. F33657-99-D-2051-0027, awarded by the United States Air Force. The Government has certain rights in this invention.

TECHNICAL FIELD

The present disclosure relates generally to flowpath components for a gas powered turbine, and more specifically to a floating wall assembly for the same.

BACKGROUND

Gas powered turbines include a compressor section that draws air in and compresses the air. The compressed air is provided to a combustor along a fluid flowpath. In the combustor, the compressed air is mixed with a fuel and combusted. The resultant gasses from the combustion are expelled across a turbine section along the fluid flowpath. The expansion of the resultant gasses across the turbine section drives the turbine section to rotate. The turbine section is connected to the compressor via a shaft, and rotation of the turbine section drives rotation of the compressor section. In some examples, such as a direct drive turbofan, or a geared turbofan engine, the shaft is further coupled to a fan fore of the compressor and drives the fan to rotate.

Air flows through the flowpath connecting each of the compressor section, the combustor section, and the turbine section. Alternative gas powered turbines, such as marine based turbines, function similarly without the utilization of outside air, and include an analogous flowpath.

Multiple static flowpath elements, such as foil shaped vanes, extend into and through the flowpath. In order to prevent the fluid in the flowpath from escaping through axial joints in the flowpath element assemblies, and thereby escape the flowpath, rope seals are typically employed along at least some of the axial joints.

Due to the nature of gas powered turbines, the gasses passing through the flowpath in the turbine section are at extreme temperatures, and can be elevated from ambient temperatures to extreme temperatures, and vice versa, when the engine is initially starting up and when the engine is winding down. The extreme temperature changes result in expansion and contraction of the flowpath element assemblies. As a result of the expansion and contraction, rope seals can be dislodged or lost, resulting in significant efficiency reductions to the gas powered turbine.

SUMMARY OF THE INVENTION

In one exemplary embodiment a foil assembly for a gas powered turbine includes a plurality of floating wall sectors arranged circumferentially about an axis defined by a flowpath. Each of the floating wall sectors including a first flowpath strut component, a second flowpath strut component, a floating wall panel connected to the first flowpath strut component by a first clamp seal at a first axial joint and connected to the second flowpath strut component by a second clamp seal at a second axial joint, and a plurality of leading edge structures fore of the plurality of floating wall sectors, each of the leading edge structures configured to define a foil profile in conjunction with a first flowpath strut component of a first floating wall sector and an adjacent flowpath strut component of a second floating wall sector.

In another exemplary embodiment of the above described foil assembly for a gas powered turbine, each clamp seal includes a radially outward clamping plate, a radially inward clamping plate, radially inward of the radially outward clamping plate, a circumferential extension of one of the first flowpath strut and the second flowpath strut received between the radially outward clamping plate and the radially inward clamping plate, a portion of the floating wall panel received between the radially outward clamping plate and the radially inward clamping plate, and at least one fastener protruding through the radially outward clamping plate and the radially inward clamping plate, the at least one fastener applying a pre-load to the radially inward clamping plate and the radially outward clamping plate.

In another exemplary embodiment of any of the above described foil assemblies for a gas powered turbine, the circumferential extension includes a radially outward facing sealing surface extending a full axial length of the circumferential extension, and a radially inward facing sealing surface extending a full axial length of the circumferential extension, the radially outward facing sealing surface contacts the radially outward clamping plate along the full axial length, and the radially inward facing sealing surface contacts the radially inward clamping surface along the full axial length.

In another exemplary embodiment of any of the above described foil assemblies for a gas powered turbine, the portion of the floating wall panel includes a radially outward facing sealing surface extending a full axial length of the floating panel wall, and a radially inward facing sealing surface extending a full axial length of the floating panel wall, the radially outward facing sealing surface contacts the radially outward clamping plate along the full axial length, and the radially inward facing sealing surface contacts the radially inward clamping surface along the full axial length.

In another exemplary embodiment of any of the above described foil assemblies for a gas powered turbine, the radially inward clamp plate includes a number of fastener features equal to the number of fasteners, and wherein each of the fastener features is configured to receive a fastener flush with the radially inward clamping plate.

In another exemplary embodiment of any of the above described foil assemblies for a gas powered turbine, the a portion of the floating wall panel received between the radially outward clamping plate and the radially inward clamping plate is radially thinner than a remainder of the floating wall panel not received between a radially outward clamping plate and a radially inward clamping plate.

In another exemplary embodiment of any of the above described foil assemblies for a gas powered turbine, each of the sectors further includes a spoke centering boss including a partial hole configured to receive a spoke.

In another exemplary embodiment of any of the above described foil assemblies for a gas powered turbine, each of the sectors is connected to a turbine static element via a spoke, and wherein each of the sectors is maintained in position relative to each other of the sectors via the spoke.

In another exemplary embodiment of any of the above described foil assemblies for a gas powered turbine, the foil assembly is disposed in a turbine engine exhaust case.

In another exemplary embodiment of any of the above described foil assemblies for a gas powered turbine, each of the floating wall sectors defines a portion of a gas powered turbine flowpath and wherein surfaces defining the portion of the gas powered turbine are heat treated.

In another exemplary embodiment of any of the above described foil assemblies for a gas powered turbine, each of the defined foil profiles includes a radially aligned central opening, and wherein at least one of the defined foil profiles includes a flowpath pass-through component.

In another exemplary embodiment of any of the above described foil assemblies for a gas powered turbine, a radially inward surface of the floating wall panel, a radially inward facing surface of at least one fastener, and a radially inward facing surface of each of the radially inward clamping walls are flush.

In one exemplary embodiment a floating wall sector for a foil assembly of a gas powered turbine includes a radially outward floating wall panel including a first edge generally aligned with an axis defined by the floating wall sector and a second edge generally aligned with the axis, a first strut component including a circumferential extension aligned with the floating wall panel and a strut extending radially inward from the circumferential extension, a second strut component including a circumferential extension aligned with the floating wall panel and a strut extending radially inward from the circumferential extension, a first clamp seal connecting the circumferential extension of the first strut component to the floating wall panel at the first edge, and a second clamp seal connecting the circumferential extension of the second strut component to the floating wall panel at the second edge.

In another exemplary embodiment of the above described floating wall sector for a foil assembly of a gas powered turbine, each of the first edge and the second edge is radially thinner than a remainder of the floating wall panel.

In another exemplary embodiment of the above described floating wall sector for a foil assembly of a gas powered turbine, the first clamp includes a first radially outward clamping plate contacting the circumferential extension of the first strut component and the first edge of the floating wall assembly, and a first radially inward clamping plate, contacting the circumferential extension of the first strut component and the first edge of the floating wall assembly. The second clamp includes a second radially outward clamping plate contacting the circumferential extension of the second strut component and the second edge of the floating wall assembly, and a second radially inward clamping plate, contacting the circumferential extension of the second strut component and the second edge of the floating wall assembly.

In another exemplary embodiment of any of the above described floating wall sectors for a foil assembly of a gas powered turbine, the first radially outward clamping plate and the first radially inward clamping plate are pre-loaded with a clamping force via at least one fastener, and the second radially outward clamping plate and the second radially inward clamping plate are pre-loaded with a clamping force via at least one fastener.

In another exemplary embodiment of any of the above described floating wall sectors for a foil assembly of a gas powered turbine, the strut extending radially inward from the first strut component is a pressure surface of a foil and wherein the strut extending radially inward from the second strut component is a suction surface of a foil.

An exemplary method for sealing a sector of a floating wall assembly in a gas powered turbine includes providing a clamping force from a generally axially aligned clamping seal, the clamping force retaining a strut component and a floating wall panel in position relative to each other and sealing the joint between the strut component and the floating wall panel.

A further example of the above exemplary method for sealing a sector of a floating wall assembly in a gas powered turbine includes providing a clamping force comprises pre-loading at least one fastener such that a radially outward clamping plate and a radially inward clamping plate are pinched against a circumferential extension of the strut and an axially aligned portion of the floating wall panel.

Another example of any of the above exemplary methods for sealing a sector of a floating wall assembly in a gas powered turbine further includes maintaining a seal during thermal expansion and contraction of the floating wall assembly.

These and other features of the present invention can be best understood from the following specification and drawings, the following of which is a brief description.

DETAILED DESCRIPTION OF AN EMBODIMENT

Figure 1:
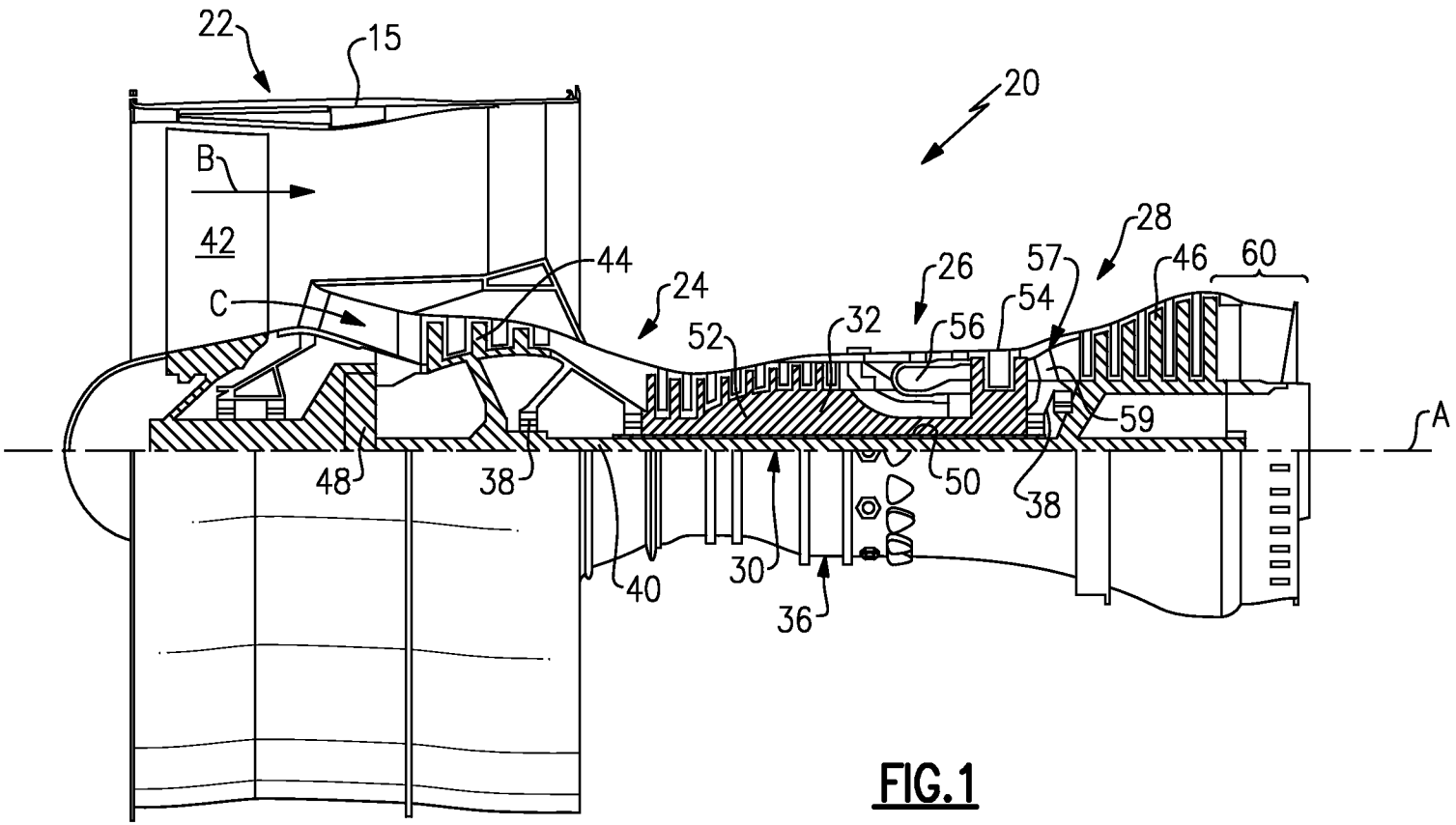
FIG. 1 schematically illustrates an exemplary gas powered turbine.

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. Alternative engines might include an augmentor section (not shown) among other systems or features. The fan section 22 drives air along a bypass flow path B in a bypass duct defined within a nacelle 15, while the compressor section 24 drives air along a core flow path C for compression and communication into the combustor section 26 then expansion through the turbine section 28. Although depicted as a two-spool turbofan gas turbine engine in the disclosed non-limiting embodiment, it should be understood that the concepts described herein are not limited to use with two-spool turbofans as the teachings may be applied to other types of turbine engines including three-spool architectures, direct drive turbofans, or any other turbine based architecture.

The exemplary engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided, and the location of bearing systems 38 may be varied as appropriate to the application.

The low speed spool 30 generally includes an inner shaft 40 that interconnects a fan 42, a first (or low) pressure compressor 44 and a first (or low) pressure turbine 46. The inner shaft 40 is connected to the fan 42 through a speed change mechanism, which in the exemplary gas turbine engine 20 is illustrated as a geared architecture 48 to drive the fan 42 at a lower speed than the low speed spool 30. The high speed spool 32 includes an outer shaft 50 that interconnects a second (or high) pressure compressor 52 and a second (or high) pressure turbine 54. A combustor 56 is arranged in exemplary gas turbine 20 between the high pressure compressor 52 and the high pressure turbine 54. A mid-turbine frame 57 of the engine static structure 36 is arranged generally between the high pressure turbine 54 and the low pressure turbine 46. The mid-turbine frame 57 further supports bearing systems 38 in the turbine section 28. The inner shaft 40 and the outer shaft 50 are concentric and rotate via bearing systems 38 about the engine central longitudinal axis A which is collinear with their longitudinal axes.

The core airflow is compressed by the low pressure compressor 44 then the high pressure compressor 52, mixed and burned with fuel in the combustor 56, then expanded over the high pressure turbine 54 and low pressure turbine 46. The mid-turbine frame 57 includes airfoils 59 which are in the core airflow path C. The turbines 46, 54 rotationally drive the respective low speed spool 30 and high speed spool 32 in response to the expansion. It will be appreciated that each of the positions of the fan section 22, compressor section 24, combustor section 26, turbine section 28, and fan drive gear system 48 may be varied. For example, gear system 48 may be located aft of combustor section 26 or even aft of turbine section 28, and fan section 22 may be positioned forward or aft of the location of gear system 48.

Aft of the turbine section 28 in some exemplary gas powered turbines is a turbine exhaust case 60 including multiple flow correcting elements, such as vanes, protruding radially inward into the flowpath. Each of the flow correcting elements has a foil profile and is exposed to the extreme temperatures, and extreme temperature shifts of the turbine section 28. As a result of the temperature shifts, the assemblies and flowpath elements expand and contract resulting in relative movement between the components of the flowpath elements. By way of example, a turbine engine exhaust case 60 can include a set of circumferentially arranged floating wall sectors. The floating wall sectors operate in conjunction to define a floating wall assembly including a set of foil shaped vanes protruding radially inward into the flowpath C. Each of the floating wall sectors includes multiple components that can expand and contract at different rates, resulting in varied growth situations. In such a situation, a rope seal can be dislodged leading to undesirable efficiency losses.

Figure 2:
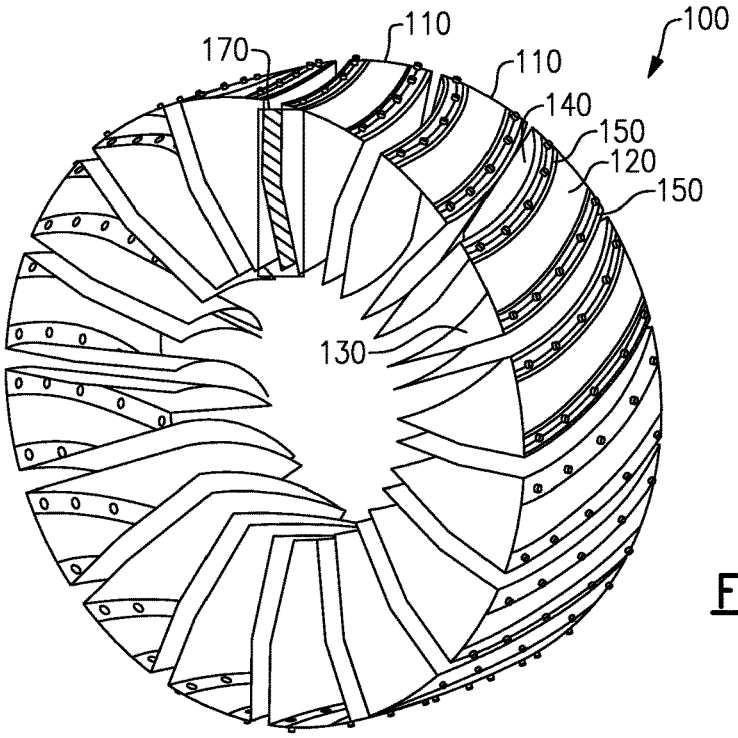
FIG. 2 schematically illustrates a floating wall assembly for the gas powered turbine of FIG. 1.

Referring now to FIG. 2, a floating wall assembly 100 is illustrated removed from a gas powered turbine for explanation purposes. The floating wall assembly 100 is constructed of multiple individual, and approximately identical, sectors 110. In some examples, the sectors 110 include variations designed to accommodate other features of the gas powered turbine. The sectors 110 are arranged circumferentially around the flowpath C and maintained in a relative position via a mechanical connection to gas powered turbine static elements.

Each of the sectors 110 includes a floating wall panel 120 connecting a concave strut component 130 and a convex strut component 140. The strut components 130, 140 are connected to the floating wall panel 120 via a corresponding clamp seal structure 150. Schematically illustrated fore of a gap 160 between a concave strut 130 and an adjacent convex strut 140, is a leading edge structure. The leading edge structure 170 operates in conjunction with the corresponding convex strut 140 and the corresponding concave strut 130 to form a foil shaped profile, with the concave strut 130 forming a pressure side of the foil and the convex strut 140 forming a suction side of the foil.

Leading edge structures 170 are arranged circumferentially about the flowpath, and can be affixed to a turbine engine exhaust case, a housing, or any other static structure of the gas powered turbine. Each of the resulting foils is includes a radially aligned opening defined between the two struts 130, 140 forming the pressure surface and the suction surface of the foil, and can include tubing, pass-throughs, or other engine components being passed through the flowpath. In some examples, the material of the struts 130, 140 and the leading edge structure 170 provide heat shielding for engine components passing through the foil shaped element.

Gas passing through the flowpath passes between the concave strut 130 and the convex strut 140 on each of the sectors 110. In some examples, the struts 130, 140 fully traverse the flow path when installed in a gas powered turbine. In alternative embodiments, the struts 130, 140 define a small gap between a radially inward end of the strut 130, 140 and a radially inward circumference of the flowpath.

Each of the sectors 110 is connected to a static engine housing element, such as a turbine exhaust case. In some examples, the sectors 110 are connected to the static housing element using a spoke centering boss arrangement. In other examples, alternative centering and attachment configurations can be utilized to connect the sectors 110 to the housing.

Figure 3A:
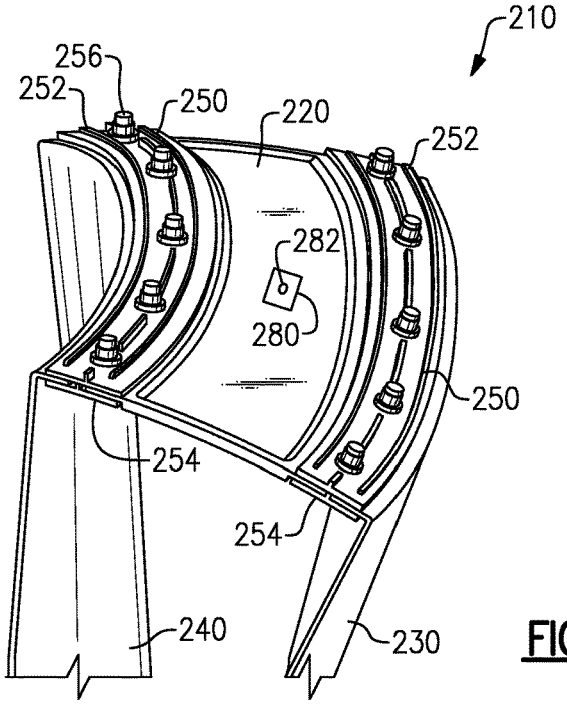
FIG. 3A schematically illustrates one segment of an exemplary floating wall assembly from a radially outward viewing position.

With continued reference to FIG. 2, FIG. 3A schematically illustrates a radially outward view of a sector 210 for a floating wall assembly, such as the floating wall assembly 100 of FIG. 2. Similarly, FIG. 3B illustrates a radially inward view of the sector 210 of FIG. 3A.

Figure 3B:
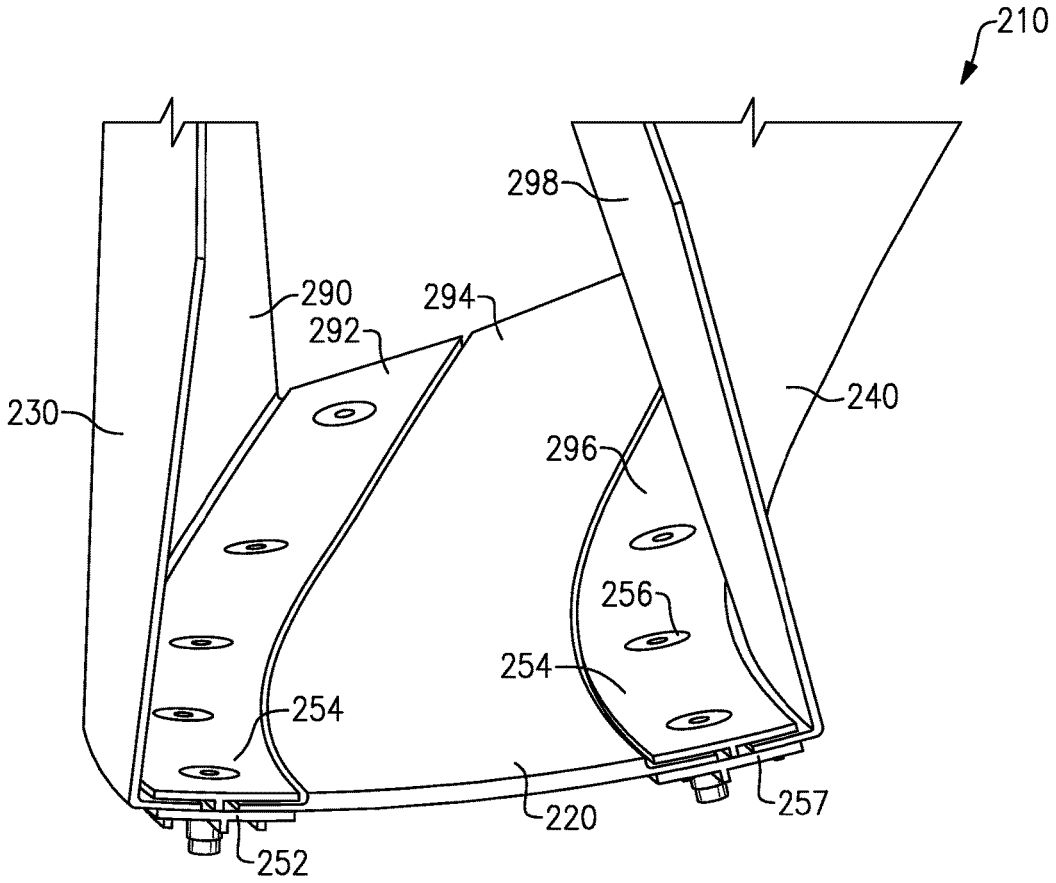
FIG. 3B schematically illustrates the segment of the exemplary floating wall assembly of FIG. 3A from a radially inward viewing position.

As with the sectors 110 of FIG. 2, the sector 210 of FIGS. 3A and 3B includes a floating wall panel 220 connecting a concave strut 230 to a convex strut 240. Each of the struts 230, 240 protrude radially inward from the floating wall panel 220 such that each of the struts 230, 240 can operate in conjunction with an adjacent strut 230, 240 protruding from an adjacent sector 210 and a leading edge component 170 to form a foil. The floating wall panel 220 is curved to fit the particular curvatures of the concave strut 230 and the convex strut 240. One of skill in the art, having the benefit of this disclosure, will understand that the particular curvature of the floating wall panel 220, and of the sector 210 in general, can be adjusted as needed to achieve a desired foil profile.

In the illustrated example, the sector 210 includes a spoke centering boss 280. The spoke centering boss 280 includes a partial hole 282 for connecting to a spoke. In an installed configuration, a spoke connected to the static engine housing is received in the partial hole 282, and the spoke maintains the sector 210 in position relative to the static engine elements. In alternative embodiments, alternative numbers or positions of spokes can be implemented to the same effect.

Each of the struts 230, 240 is connected to the floating wall panel 220 by a clamp seal 250 defining an axial joint. The clamp seals 250 each include a radially outward clamping plate 252, a radially inward clamping plate 254 and multiple fasteners 256 maintaining the clamping plates 252, 254 in position, and pre-loading the clamping plates 252, 254. Portions of the floating wall panel 220 and the corresponding strut 230, 240 are pinched between the clamping plates 252, 254 thereby providing an axial seal along the joint between the strut 230, 240 and the floating wall panel 220.

Visible in the radially inward view (FIG. 3B) of the sector 210 are surfaces 290, 292, 294, 296, 298 that define the flowpath through the floating wall assembly 100 (illustrated in FIG. 1) and are exposed to the extreme temperatures. In order to further protect the sector 210, each of the exposed surfaces 290, 292, 294, 296, 298 is protected using a heat resistant coating. The heat resistant coating can be any known coating and can be applied using conventional coating techniques. In the exemplary embodiment, the heat resistant coating is applied to the inward facing surfaces of each component of the sector 210 prior to assembly of the sector 210.

Figure 4A:
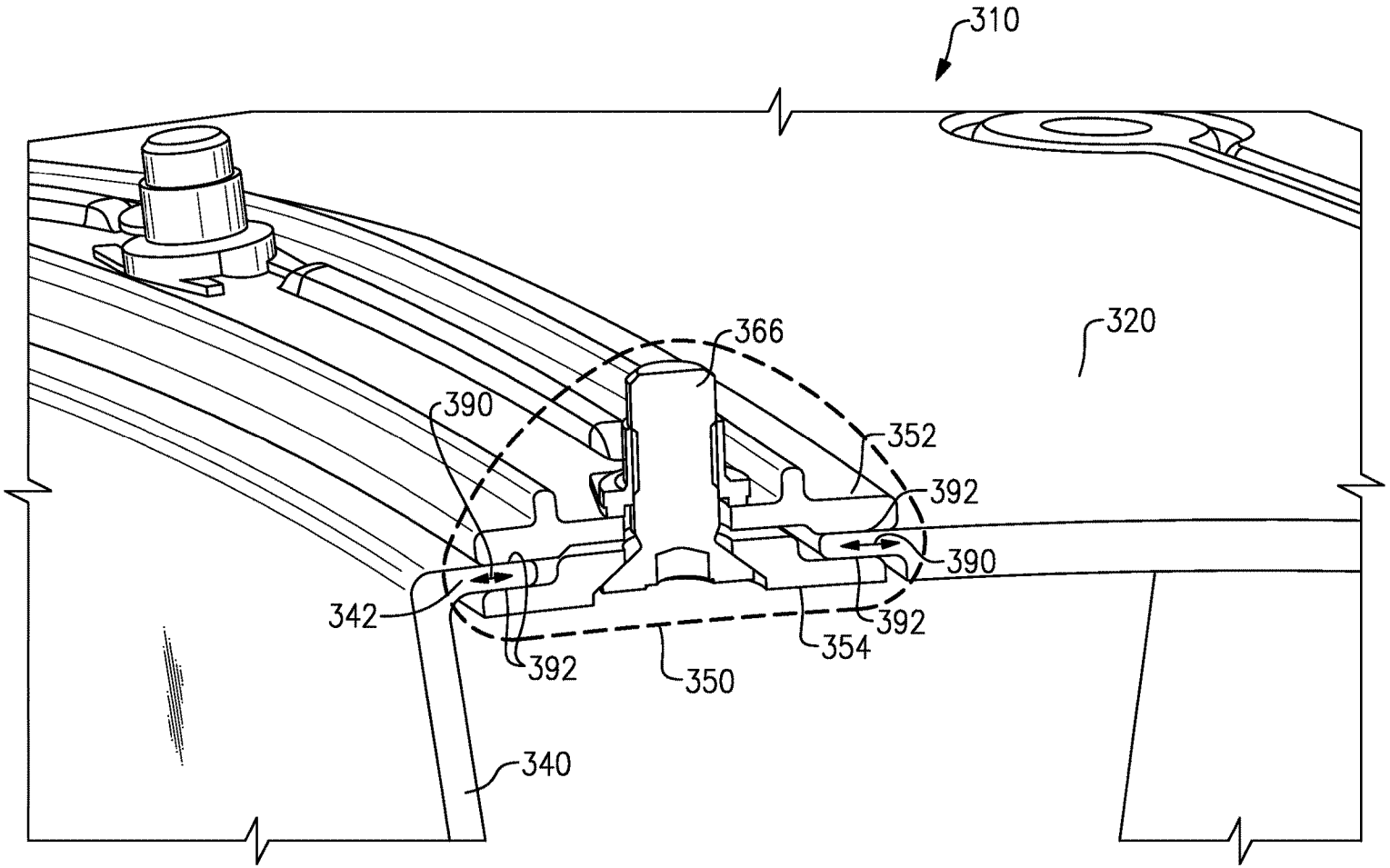
FIG. 4A schematically illustrates a cross sectional view of a clamp seal within an exemplary floating wall assembly segment at a fastener.
Figure 4B:
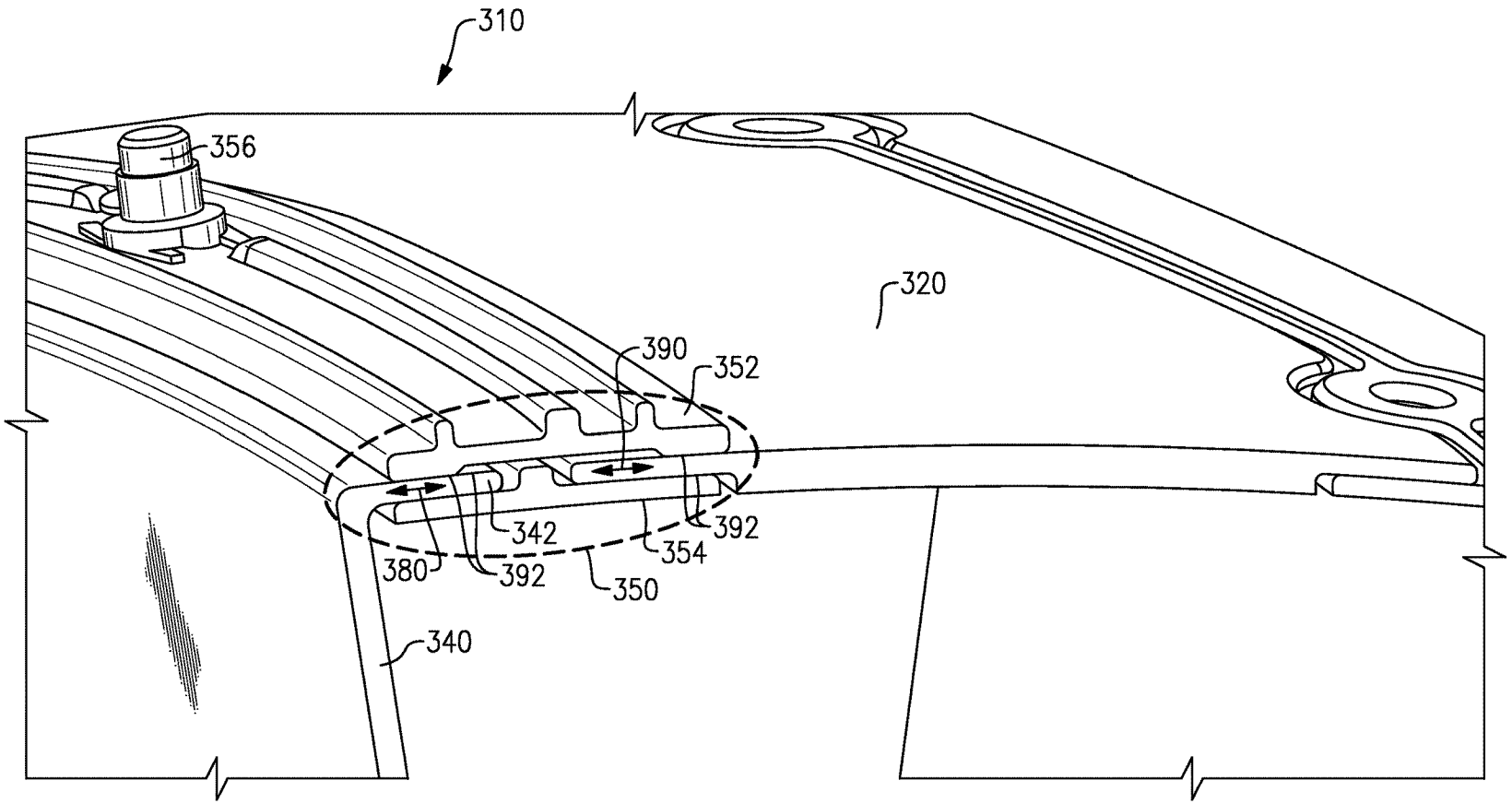
FIG. 4B schematically illustrates a cross sectional view of a clamp seal within an exemplary floating wall assembly segment between fasteners.

With continued reference to FIGS. 2, 3A and 3B, and with like numerals indicating like elements, FIG. 4A schematically illustrates a cross sectional view of a clamp seal structure 350 at a fastener 356 within an exemplary floating wall assembly sector 310. Similarly, FIG. 4B schematically illustrates a cross sectional view of the clamp seal structure 350 between fasteners 356 within the exemplary floating wall segment 310.

In the clamp seal structure 350, a radially outward clamping plate 352 is radially outward to a floating wall panel 320 and radially outward to a circumferential extension 342 of a strut 340. A corresponding radially inward clamping plate 354 is positioned radially inward of the circumferential extension 342 of the strut 340 and radially inward of the floating wall panel 320. The circumferential extension 342 of the strut 340 and the floating wall panel 320 are spaced apart circumferentially. A fastener 356, such as a bolt or screw, is passed through both the radially inward clamping plate 354 and the radially outward clamping plate 352, and through the space between the circumferential extension of the strut 340 and the floating wall panel 320. The fastener 356 is tightened, causing the clamping plates 352, 354 to compress on the circumferential extension 342 of the strut 340 and the floating wall panel 320. The compression creates a clamp seal at sealing surfaces 392. The clamp seal prevents fluids, such as combustion gasses, from escaping the primary flowpath through the joint between the generally axially aligned floating wall panel 320 and the strut 340.

As the sector 310 thermally expands and contracts the expansion and contraction causes the circumferential extension 342 and the floating wall panel 320 to shift along arrows 390 relative to the clamping plates 352, 354. During operation of the gas powered turbine, the clamp seal 350 maintains contact between the sealing surfaces 392 and the corresponding circumferential extension 342 or floating wall panel 320.

In some examples, such as the illustrated example, the portion of the floating wall panel 320 that is clamped between the clamping plates 352, 354 is radially thinner than a remainder of the floating wall panel 320, resulting in a flush inner surface of the sector 310. In alternative examples, the floating wall panel 320 is a uniform thickness.

Figure 5A:
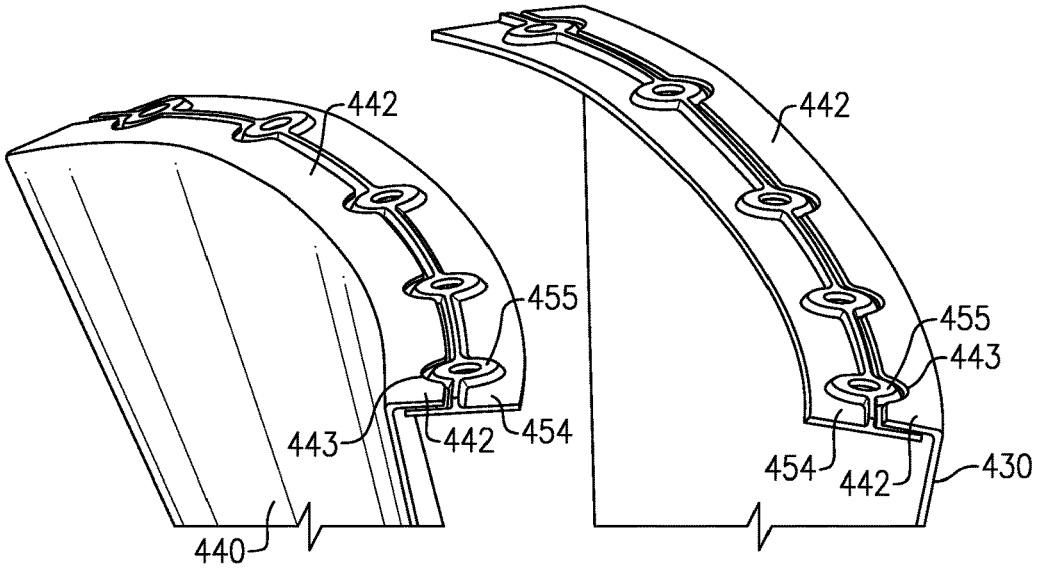
FIG. 5A illustrates an intermediate step of an assembly sequence of a floating wall assembly.
Figure 5B:
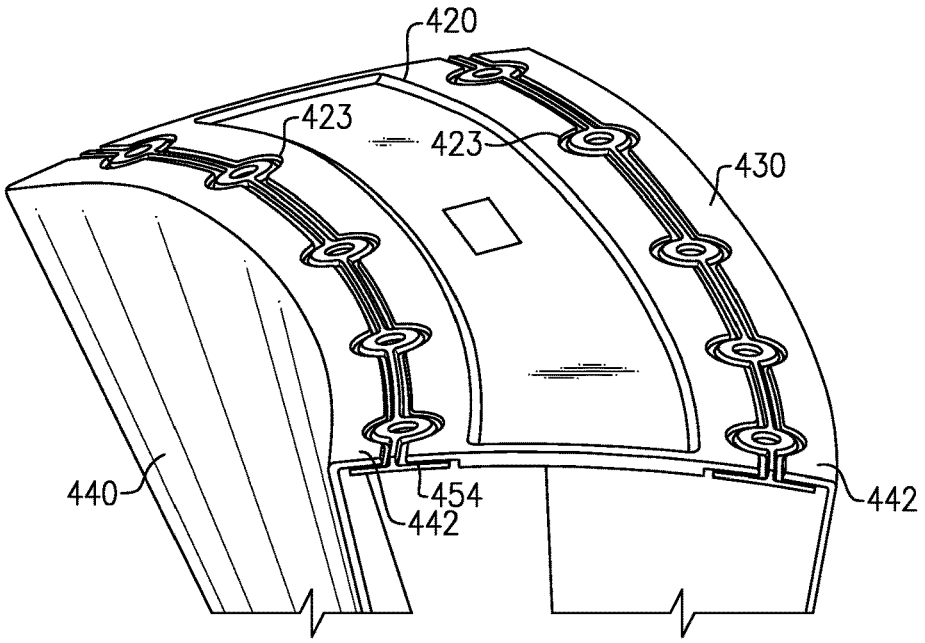
FIG. 5B illustrates another intermediate step of an assembly sequence of a floating wall assembly.
Figure 5C:
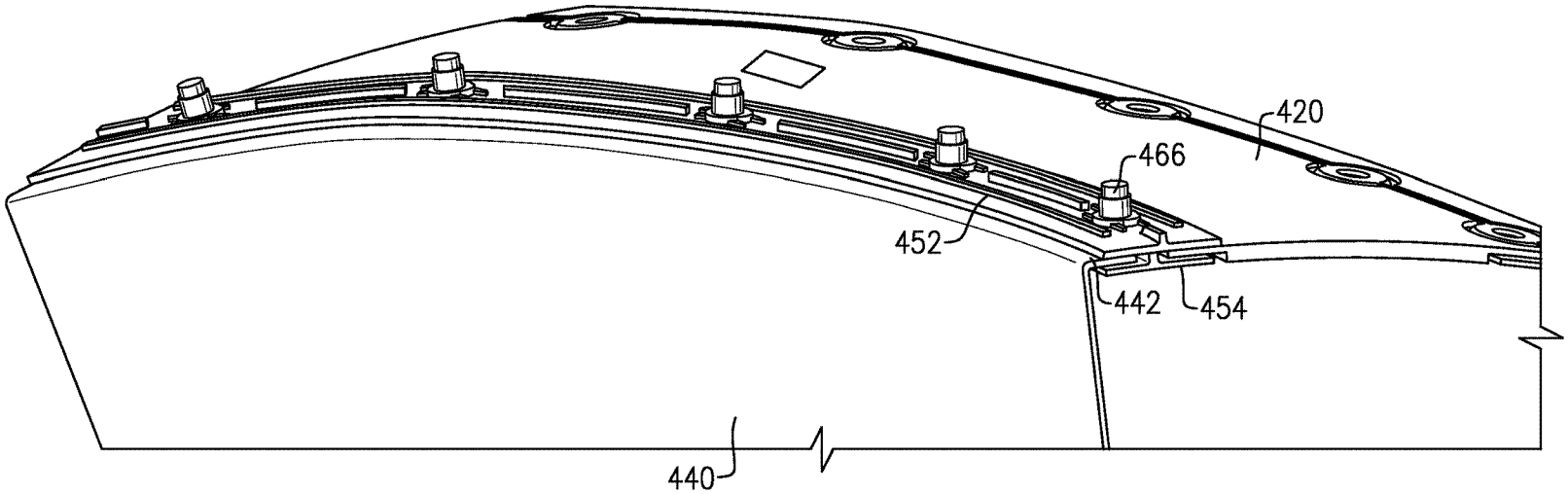
FIG. 5C illustrates another intermediate step of an assembly sequence of a floating wall assembly.

With continued reference to FIGS. 1-4B, and with like numerals indicating like elements, FIGS. 5A, 5B and 5C illustrate intermediate stages in an assembly process for assembling a sector 410 for a floating wall assembly, such as the floating wall assembly 100 of FIG. 2. Initially, a radially inward clamping plate 454 is aligned with each of the struts 430, 440 such that fastener features 455 on the radially inward clamping plates 454 are aligned with corresponding features 443 in a circumferential extension 442 of the struts 430, 440. This intermediate step is illustrated in FIG. 5A.

Once the radially inward clamping plates 454 are in position, relative to the struts 430, 440, a floating wall panel 420 is positioned radially outward of the radially inward clamping plate 454. As with the circumferential extensions 442 of the struts 430, 440, the floating wall panel 420 includes features 423 corresponding to each of the fastener features 455 on the radially inward clamping plate 454. The assembly process, with the floating wall plate in position is illustrated in FIG. 5B.

Once the floating wall panel 320 is in position, the radially outward clamping plate is positioned radially outward of the radially inward clamping plate 454, as described and illustrated above with regards to FIGS. 4A and 4B. Fasteners 356 are passed through the fastener features and maintain the clamping plates 452, 454 in position relative to each other. The fasteners 456 are tightened, applying a pre-load to the clamp seal 450, and axially sealing the flowpath along the axial joint between the struts 430, 440 and the floating wall panel 320. The fasteners 456 can be any conventional fastener type capable of providing a pre-load. A sector 410 including one of the seals 450 fully assembled is illustrated in FIG. 5C.

While illustrated and described throughout with regards to a seal connecting a convex strut to a floating wall panel, one of skill in the art will appreciate that similar seal arrangements and techniques are utilized to connect the concave strut and provide an axial seal along the joint between the concave strut and the floating wall panel.

Once each sector has been assembled, the sectors are positioned in a gas powered turbine in the circumferential arrangement illustrated in FIG. 2, and connected to a static engine housing using the above described spoke centering boss arrangement.

While described herein with specific regards to a geared turbofan engine, it is appreciated that the axial sealing techniques can be utilized in any gas powered turbine structure utilizing a similar sector arrangement for providing static foil structures. By way of example, the apparatus and techniques described herein can be utilized in direct drive turbofan engines, land based turbines, marine based turbines and the like.

Further, while described herein with regard to vane's in a turbine exhaust case, one of skill in the art having the benefit of this disclosure will understand that the clamping seal arrangement can be utilized to provide an axial seal for alternative static structures within a gas powered turbine, such as mid turbine frames, and the like.

It is further understood that any of the above described concepts can be used alone or in combination with any or all of the other above described concepts. Although an embodiment of this invention has been disclosed, a worker of ordinary skill in this art would recognize that certain modifications would come within the scope of this invention. For that reason, the following claims should be studied to determine the true scope and content of this invention.

The invention claimed is:

1. A foil assembly for a gas powered turbine comprising:
a plurality of floating wall sectors arranged circumferentially about an axis defined by a flowpath;
each of said floating wall sectors comprising;
a first flowpath strut component;
a second flowpath strut component;
a floating wall panel connected to the first flowpath strut component by a first clamp seal at a first axial joint and connected to the second flowpath strut component by a second clamp seal at a second axial joint;
a plurality of leading edge structures fore of the plurality of floating wall sectors, each of the leading edge structures configured to define a foil profile in conjunction with a first flowpath strut component of a first floating wall sector and an adjacent flowpath strut component of a second floating wall sector; and
wherein each of said clamp seals includes a radially outward clamping plate and a radially inward clamping plate, radially inward of the radially outward clamping plate.

2. A foil assembly for a gas powered turbine comprising:
a plurality of floating wall sectors arranged circumferentially about an axis defined by a flowpath;
each of said floating wall sectors comprising;
a first flowpath strut component;
a second flowpath strut component;
a floating wall panel connected to the first flowpath strut component by a first clamp seal at a first axial joint and connected to the second flowpath strut component by a second clamp seal at a second axial joint;
a plurality of leading edge structures fore of the plurality of floating wall sectors, each of the leading edge structures configured to define a foil profile in conjunction with a first flowpath strut component of a first floating wall sector and an adjacent flowpath strut component of a second floating wall sector; and
wherein each of said clamp seals comprises:
a radially outward-clamping plate;
a radially inward clamping plate, radially inward of the radially outward clamping plate;
a circumferential extension of one of said first flowpath strut and said second flowpath strut received between said radially outward clamping plate and said radially inward clamping plate;
a portion of said floating wall panel received between said radially outward clamping plate and said radially inward clamping plate; and
at least one fastener protruding through said radially outward clamping plate and said radially inward clamping plate, the at least one fastener applying a pre-load to said radially inward clamping plate and said radially outward clamping plate.

3. The foil assembly of claim 2, wherein said circumferential extension includes a radially outward facing sealing surface extending a full axial length of the circumferential extension, and a radially inward facing sealing surface extending a full axial length of the circumferential extension, said radially outward facing sealing surface contacts said radially outward clamping plate along the full axial length, and said radially inward facing sealing surface contacts said radially inward clamping surface along the full axial length.

4. The foil assembly of claim 2, wherein said portion of said floating wall panel includes a radially outward facing sealing surface extending a full axial length of the floating panel wall, and a radially inward facing sealing surface extending a full axial length of the floating panel wall, said radially outward facing sealing surface contacts said radially outward clamping plate along the full axial length, and said radially inward facing sealing surface contacts said radially inward clamping surface along the full axial length.

5. The foil assembly of claim 2 wherein said radially inward clamp plate includes a number of fastener features equal to the number of fasteners, and wherein each of said fastener features is configured to receive a fastener flush with said radially inward clamping plate.

6. The foil assembly of claim 2, wherein said a portion of said floating wall panel received between said radially outward clamping plate and said radially inward clamping plate is radially thinner than a remainder of said floating wall panel not received between a radially outward clamping plate and a radially inward clamping plate.

7. The foil assembly of claim 6, wherein each of said sectors is connected to a turbine static element via a spoke, and wherein each of said sectors is maintained in position relative to each other of said sectors via said spoke.

8. The foil assembly of claim 2, wherein each of said sectors further includes a spoke centering boss including a partial hole configured to receive a spoke.

9. The foil assembly of claim 2, wherein each of said floating wall sectors defines a portion of a gas powered turbine flowpath and wherein surfaces defining said portion of said gas powered turbine are heat treated.

10. The foil assembly of claim 2, wherein each of said defined foil profiles includes a radially aligned central opening, and wherein at least one of said defined foil profiles includes a flowpath pass-through component.

11. The foil assembly of claim 2, wherein a radially inward surface of the floating wall panel, a radially inward facing surface of at least one fastener, and a radially inward facing surface of each of the radially inward clamping plates are flush.

12. A foil assembly for a gas powered turbine comprising:
a plurality of floating wall sectors arranged circumferentially about an axis defined by a flowpath;
each of said floating wall sectors comprising;
a first flowpath strut component;
a second flowpath strut component;
a floating wall panel connected to the first flowpath strut component by a first clamp seal at a first axial joint and connected to the second flowpath strut component by a second clamp seal at a second axial joint;
a plurality of leading edge structures fore of the plurality of floating wall sectors, each of the leading edge structures configured to define a foil profile in conjunction with a first flowpath strut component of a first floating wall sector and an adjacent flowpath strut component of a second floating wall sector; and
wherein said foil assembly is disposed in a turbine engine exhaust case.

13. A floating wall sector for a foil assembly of a gas powered turbine comprising:
a radially outward floating wall panel including a first edge generally aligned with an axis defined by the floating wall sector and a second edge generally aligned with the axis;
a first strut component including a circumferential extension aligned with the floating wall panel and a strut extending radially inward from the circumferential extension;

a second strut component including a circumferential extension aligned with the floating wall panel and a strut extending radially inward from the circumferential extension;

a first clamp seal connecting the circumferential extension of the first strut component to the floating wall panel at the first edge;

a second clamp seal connecting the circumferential extension of the second strut component to the floating wall panel at the second edge;

wherein said first clamp includes a first radially outward clamping plate contacting said circumferential extension of said first strut component and said first edge of said floating wall assembly, and a first radially inward clamping plate, contacting said circumferential extension of said first strut component and said first edge of said floating wall assembly; and wherein said second clamp includes a second radially outward clamping plate contacting said circumferential extension of said second strut component and said second edge of said floating wall assembly, and a second radially inward clamping plate, contacting said circumferential extension of said second strut component and said second edge of said floating wall assembly.

14. The floating wall sector of claim 13, wherein each of said first edge and said second edge is radially thinner than a remainder of said floating wall panel.

15. The floating wall sector of claim 13, wherein said first radially outward clamping plate and said first radially inward clamping plate are pre-loaded with a clamping force via at least one fastener, and said second radially outward clamping plate and said second radially inward clamping plate are pre-loaded with a clamping force via at least one fastener.

16. The floating wall sector of claim 13, wherein the strut extending radially inward from the first strut component is a pressure surface of a foil and wherein the strut extending radially inward from the second strut component is a suction surface of a foil.

* * * * *